United States Patent [19]

Ritter et al.

[11] Patent Number: 4,919,395

[45] Date of Patent: Apr. 24, 1990

[54] APPARATUS FOR HEAT TREATING A CONTINUOUSLY MOVING METAL WIRE

[75] Inventors: Gerhard Ritter; Klaus Ritter; Günther Stoisser, all of Graz, Austria

[73] Assignee: EVG Entwicklungs-u.Verwertungs-Gesellschaft m.b.H., Styria, Austria

[21] Appl. No.: 325,094

[22] Filed: Mar. 15, 1989

Related U.S. Application Data

[63] Continuation of Ser. No. 135,342, Dec. 21, 1987, abandoned.

[30] Foreign Application Priority Data

Jan. 9, 1987 [AT] Austria ..... 35/87

[51] Int. Cl.[5] ..... C21D 9/56

[52] U.S. Cl. ..... 266/103; 242/47.01; 242/47.08; 266/110

[58] Field of Search ..... 266/103, 102, 108, 110, 266/111; 242/47.01, 47.08, 47.09

[56] References Cited

U.S. PATENT DOCUMENTS

| | | | |
|---|---|---|---|
| 1,315,835 | 9/1919 | Hepworth | 266/112 |
| 2,622,860 | 12/1952 | Lorig | 266/103 |
| 2,965,368 | 12/1960 | Mcilvried | 148/156 |
| 3,325,620 | 6/1967 | Hunt et al. | 266/103 |
| 3,422,241 | 1/1969 | Bellem | 242/47.08 |
| 3,842,643 | 10/1974 | Large et al. | 72/286 |
| 4,364,728 | 12/1982 | Stamp | 266/103 |
| 4,421,304 | 12/1983 | Hesterlee | 266/103 |
| 4,620,884 | 11/1986 | Heath | 148/128 |

FOREIGN PATENT DOCUMENTS

| | | |
|---|---|---|
| 847707 | 2/1977 | Belgium . |
| 595364 | 4/1934 | Fed. Rep. of Germany . |
| 675130 | 4/1939 | Fed. Rep. of Germany . |
| 1270587 | 6/1968 | Fed. Rep. of Germany . |
| 2533288 | 2/1977 | Fed. Rep. of Germany . |
| 2701828 | 7/1977 | Fed. Rep. of Germany . |
| 57-94531 | 9/1982 | Japan . |
| 844238 | 8/1960 | United Kingdom . |
| 969191 | 9/1964 | United Kingdom . |
| 1114261 | 5/1968 | United Kingdom . |
| 1288767 | 9/1972 | United Kingdom . |

*Primary Examiner*—Melvin J. Andrews
*Assistant Examiner*—Margery S. Phipps
*Attorney, Agent, or Firm*—Marmorek, Guttman & Rubenstein

[57] ABSTRACT

Apparatus for heat treating a continuously moving metal wire (19) has at least two drum-like rotational body systems (5*a*, 5*b*) which are arranged in the heat-treatment area and around which the wire winds with several turns, and which, to avoid the relative movement between the wire and the surface of the rotational bodies as a result of a length change in the wire during the heat treatment, are each constructed of several disc-shaped rotational bodies (5) which are arranged in sequence, are termed below in short as "discs" and have at their periphery self-contained wire-guiding grooves (6), with all discs of one disc row (5*a*) being faced by allocated discs of another disc row (5*b*) with axially offset wire-guide grooves (6). The first disc (5A) of one of the disc rows (5*a*) is connected non-rotationally to a drive shaft (3), whereas the remaining discs of this disc row (5*a*) and the discs of the other disc row (5*b*) or disc rows, possibly with the exception of a likewise driven disc, are rotatably mounted on shafts or axles (4).

14 Claims, 4 Drawing Sheets

APPARATUS FOR HEAT TREATING A CONTINUOUSLY MOVING METAL WIRE

This is a continuation of application Ser. No. 135,342, filed Dec. 21, 1987, now abandoned.

The invention relates to an apparatus for heat treating a continuously moving metal wire while using rotational bodies which are arranged in the heat-treatment area and around which the wire winds several times.

Reference is had to the application Ser. No. 99,066 filed on Sep. 21, 1987 by Gerhard Ritter and Klaus Ritter, both being among the joint inventors of the instant application; and both said applications are assigned to the same assignee.

Apparatuses of this generic type, in a spacesaving type of construction, permit a relatively long dwell time of the wire in the heat-treatment zone. When the wire is continuously drawn off from the run-off end of a rotational body around which the wire winds, the wire should bear as uniformly as possible against the periphery of the rotational body to avoid any arbitrary displacement of the turns and to ensure a distributed static friction for the wire feed. Since the wire lengthens during heating as a result of the thermal expansion, in order to achieve close contact with the surface of a cylindrical rotational body, it must slide with friction on this surface, as a result of which the requisite tensile force on the wire increases correspondingly.

Moreover, when the wire is in close contact with the rotational body, a problem arises during interruptions in operation irrespective of their cause. One cause of an interruption in operation can be that the wire becomes tangled when being drawn off from a reel. In the case of an interruption during wire annealing, the wire section remaining in the heat treatment zone is heated so long that it is practically burnt out and thus becomes useless, with the additional risk that the wire contracts again during possible cooling, as a result of the resistance of the rigid rotational body, and is subjected to such high tensile stresses that it tears. This tearing risk also exists in an interruption in operation during a cooling treatment of a wire wound closely around a rigid rotational body.

The object of the invention, in a heat-treatment apparatus of the generic type specified at the beginning, is therefore to remove the risk of over-stressing the wire held in contact with the rotational bodies and in particular to remove the risk of tearing in the event of an interruption in operation which is deliberate or is forced by a fault.

This object is achieved according to the invention by means of disc-shaped rotational bodies, which at the periphery have self-contained wire-guide grooves, and which are arranged in sequence along at least two parallel geometric axes, with all discs along one axis being faced by allocated discs along another axis with axially offset wire-guide grooves, and wherein the first disc of one of the disc rows is connected non-rotationally to a drive shaft on which the remaining discs of the same disc row are rotatably mounted, whereas the discs of the other disc row(s) are either all rotatably mounted on, in each case, a fixed axle or on a towed shaft or else are rotatably mounted on, in each case, a shaft which is driven in the same direction as the first-mentioned drive shaft and to which a disc of the other relevant disc row is, if necessary, connected non-rotationally.

In this way, as explained in greater detail later with reference to exemplary embodiments, the disc-shaped rotational bodies arranged in sequence along parallel axes form a system around which the turns of the wire wind and in which the entire length of the wire section winding around the system, as a result of the expansion or contraction of the wire, can change both in normal operation and in the event of a fault without the wire in the wound areas having to slide with friction on the surface of the disc-shaped rotational bodies, since the individual disc-shaped rotational bodies can turn relative to one another with relatively slight bearing friction.

For brevity, the disc-shaped rotational bodies are designated hereinafter as "discs"; arranging such discs in sequence results in a combined drum-like rotational body. The apparatus according to the invention contains at least two of such combined drum-like rotational bodies. The wire is fed via the driven first disc of a first disc row; the wire can be drawn off from the apparatus by draw-off means arranged outside the apparatus or by the last disc of the last disc row being connected non-rotationally to a driven shaft. The requisite relative rotations between the individual discs of a disc row, in the event of heating or cooling of the wire winding around them, can be reduced if the diameters of the discs increase along the disc rows in relation to the thermal expansion of the wire to be expected along the disc rows, the intention being for this increase to preferably take place over-proportionally so that each disc exerts a slight tensile effect on the adjoining wire.

BRIEF DESCRIPTION OF THE DRAWINGS

Three examples of apparatus according to the invention will now be described with reference to the accompanying drawings, in which:

In the apparatus of FIGS. 1 and 2 can be seen two parallel side walls 1 which are connected by a base plate 2. Parallel shafts 3, 4 pass through the space between the side walls 1 and support in each case a row 5*a* and 5*b* respectively of disc-shaped rotational bodies 5, "discs" for short, each of which has at its periphery several, preferably two, self-contained wire-guide grooves 6 (cf. FIG. 4). At adjacent ends the two shafts 3 and 4 are connected non-rotationally to spur gears 7, 8. The spur gears 7, 8 mesh with a third spur gear 10 supported by a motor-driven shaft 9. This arrangement enables both shafts 3 and 4 to be driven in the same direction at the same angular velocity.

As shown in FIGS. 4 and 5, each disc 5 sits with its hub 15 on a bush 16 which is positively connected to the hub 15 by means of two projections 17. A second bush 18 is connected non-rotationally to the shaft 3, supporting the discs 5. The two bushes 16 and 18 are made of a highly refractory material, for example ceramic oxide or graphite. Spacer discs 20 produced from the same material hold adjacent discs 5 at a desired mutual distance apart and prevent direct friction between these discs. The arrangement described enables the discs 5 to rotate relative to each other and to the shaft supporting them, but with a certain frictional resistance to be overcome in each case.

Only the first disc 5A at the input-side end of the disc row **5*a* supported by the shaft 3 is connected for rotation with the shaft, which is motor-driven. The disc 5A, as indicated by the arrow P1, therefore draws the wire 19 approaching the apparatus off a reel (not shown) or another suitable wire supply carrier. In order to apply an appropriate draw power, the disc 5A, at its periphery, expediently has at least three wire-guide grooves 6**.

Figure 4:
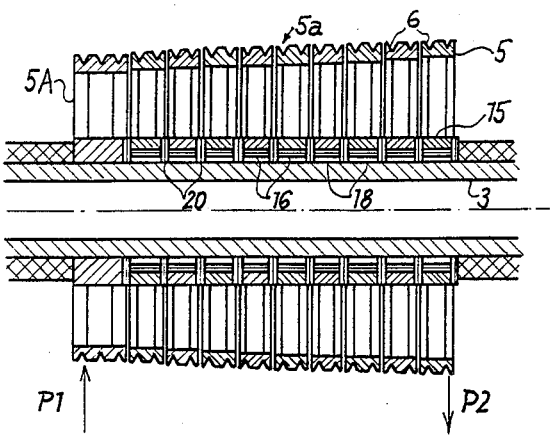
FIG. 4 shows an axial section through a number of disc-shaped rotational bodies on a shaft supporting them.

As can further be seen from FIG. 4, in preferred embodiments of the invention, all further discs 5 starting at the disc 5A of the disc row **5*a*, are stepped individually or in groups, with the increase in diameter between adjacent discs or between adjacent groups of discs preferably being slightly greater than would be necessary to compensate for longitudinal expansion of the wire being heated in the apparatus. As a result of this measure, the peripheral speeds of adjacent discs or adjacent groups of discs increase in stages at the same angular velocity of all discs. The wire gradually being heated during its passage through the apparatus can thereby always be kept in contact with the wire-guide grooves 6 of the discs 5 partly enclosed by it, in particular if these discs 5, as a result of an over-proportionally large increase in diameter in relation to the thermal expansion of the wire, attempt to convey the wire faster than would correspond to its approach speed, increased by the longitudinal expansion of the wire which occurs until a certain disc 5 of the disc row 5*a* is reached. This is because the individual discs 5 are thereby forced to lag slightly in their angular velocity relative to the shaft 3 supporting them. A wire tension is maintained as a result of the frictional forces occurring at the same time between the shaft 3 and the discs 5**.

Figure 5:
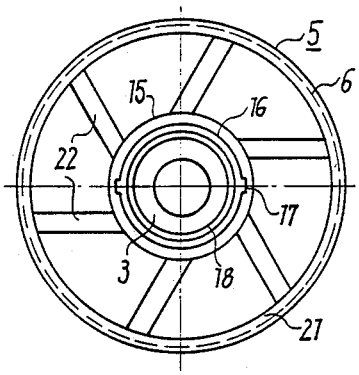
FIG. 5 shows in plan view a preferred design of the disc-shaped rotational bodies; and, FIGS. 6 and 7 show a third exemplary embodiment in axial section and a plan view with the hood removed.

In order to keep the heat-retaining capacity of the individual discs 5 as low as possible, as FIG. 5 reveals, these are expediently designed as spoked wheels with a thin wheel rim 21 which has the wire-guide grooves 6 and which is connected to the hub 15 by spokes 22 set at an angle and if necessary designed as cooling vanes. The load on the wheel rim 21 as a result of the thermal expansion of the spokes is reduced by the angular positioning of the spokes. Finally, in the hollow design of the shaft as shown, a coolant can also flow through the shaft in order to prevent overheating of the shaft and the bearing parts.

Referring back to FIGS. 1 and 2, as can now be recognized, the wire enters into the apparatus at P1, in the first groove of the first disc 5A of the disc row **5*a*, which disc 5A, is first of all guided through 180° around the disc 5A and is then directed to the first groove of the first disc 5 of the disc row 5*b*, which disc 5 is allocated to the disc 5A and, in approximately the same plane as the latter, is rotatably mounted on the shaft 4, from which disc 5, after winding around this disc likewise through 180°, is guided back etc. to the second groove of the disc 5A of the disc row 5*a***.

Moreover, the discs 5 are arranged in sequence along the shafts 3 and 4 in such a way that each groove of a disc of the row **5*b* on the shaft 4 lies in the plane of the intermediate space between adjacent grooves of the allocated disc of the row 5*a* on the shaft 3. The wire is thus continuously guided through the apparatus, away from the entry point P1, in each case alternately winding through 180° around discs allocated to one another on the shafts 3 and 4, until it finally emerges again from the apparatus at P2**.

There are various ways of driving the apparatus.

First of all it would be possible to simply drive the shaft 3 to which the disc 5A is connected for rotation. All remaining discs 5 on the shaft 3 and all the discs on the shaft 4 can then be rotated in the manner already described relative to the shafts supporting them. The shaft 4 would then be a "towed shaft", i.e. it can be rotatably mounted at its two ends without having to be directly driven. It is then driven along only by the frictional forces which are exerted on it by the discs 5 of the disc row **5*b* which are arranged on it, i.e. it will rotate with an average angular velocity corresponding approximately to the average angular velocity of the discs arranged on it. But on the other hand the bearer of the disc row 5*b*** could also be designed as an axle, i.e. designed such that it cannot itself rotate.

In both of the above-mentioned cases, all the discs 5 of the row **5*b* arranged along the shaft or axle 4 could also have the same diameter throughout, and merely the discs 5 of the row 5*a* arranged along the driven shaft 3 could have the progressive diameter increase already mentioned. In the simplest embodiment of the invention, shown in FIGS. 1 and 2, the discs on the two shafts or axles 3, 4** have the same diameter.

Figure 1:
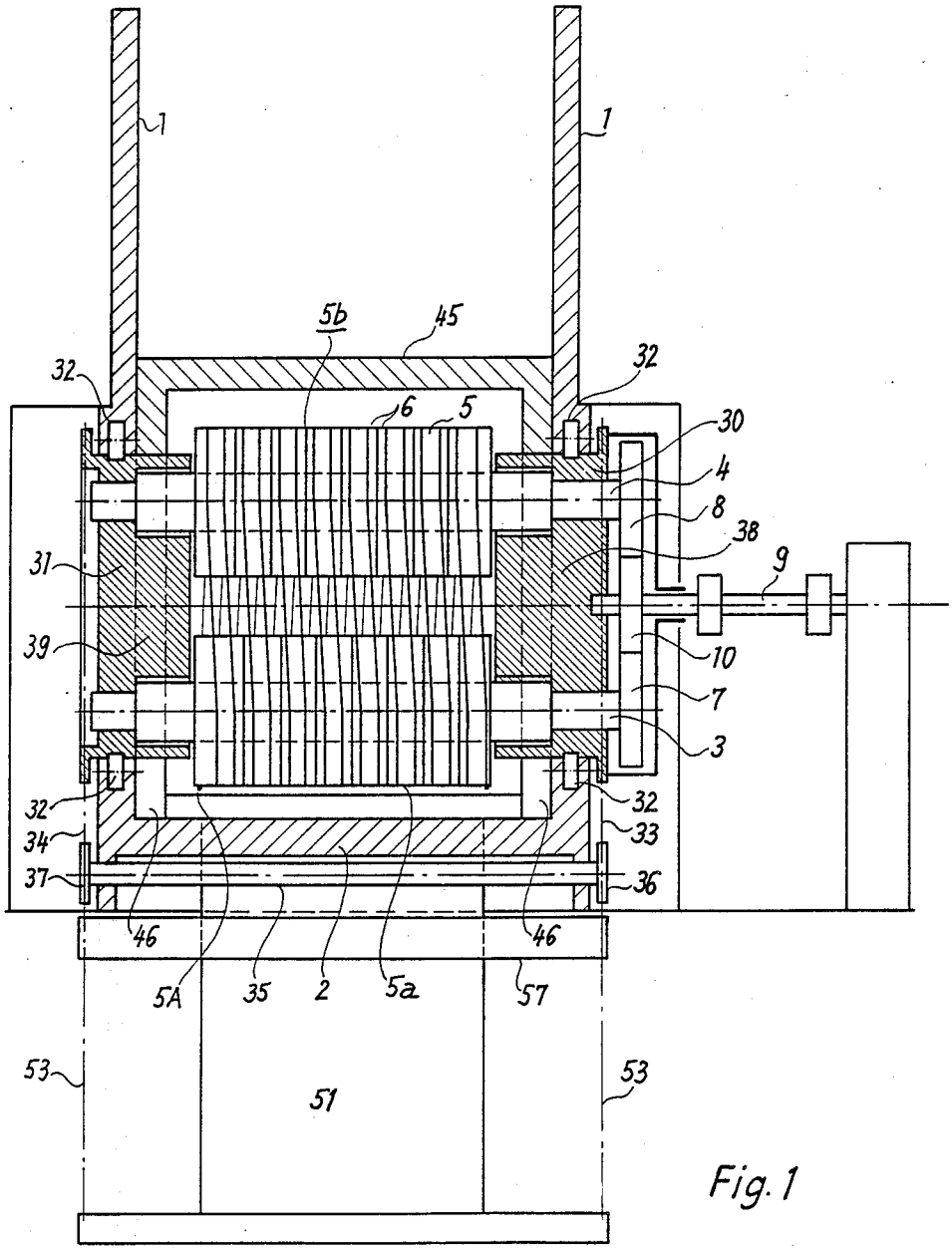
FIGS. 1 and 2 show sections, taken at right angles to one another, through a first exemplary embodiment.
Figure 2:
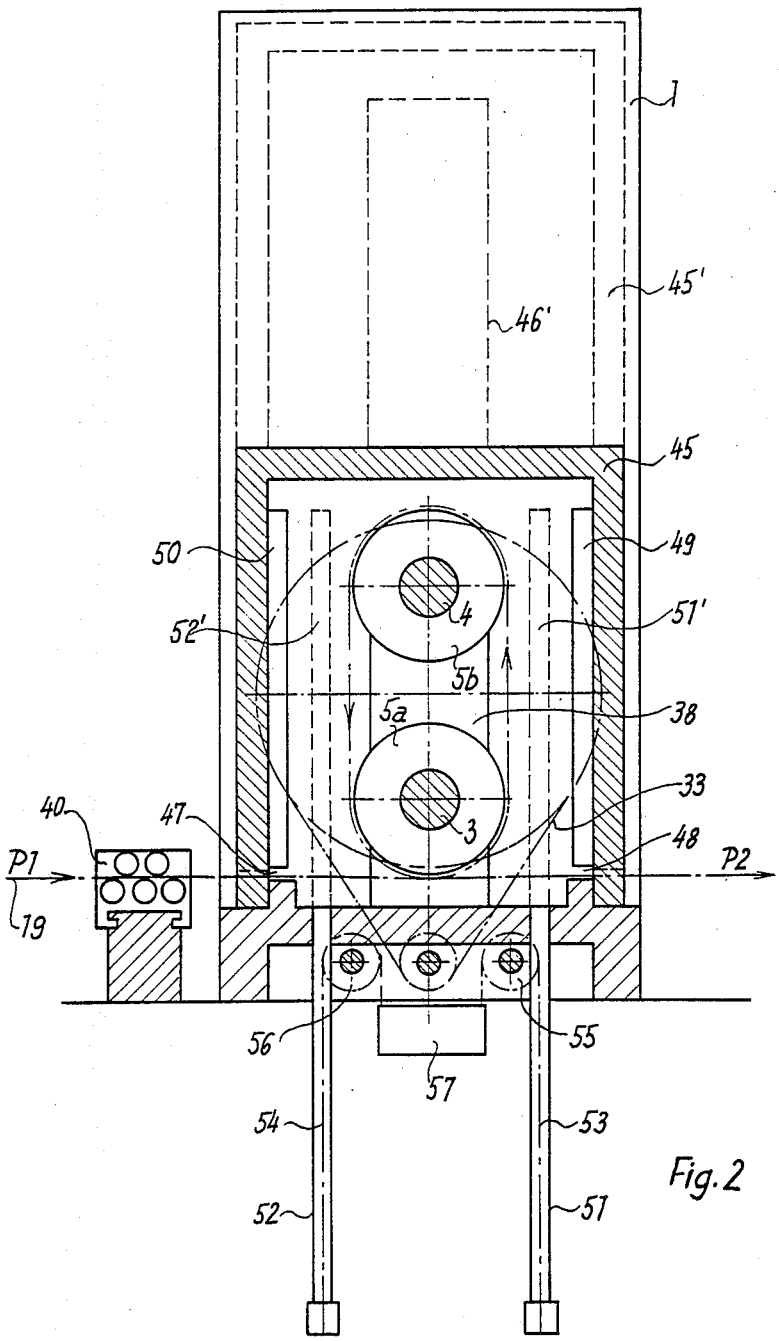

In the preferred embodiment shown in FIGS. 1 and 2, both shafts 3 and 4, in the manner already described at the beginning, are designed such that they can be driven via the spur gears 7, 8 and 10. In this embodiment, it is also expedient to design the discs along the shaft 4 with a progressively increasing diameter, it being possible for all discs to be rotatably mounted relative to the shaft 4 so that they are driven along only by friction.

Finally, it would also be possible to connect for rotation a disc of the disc row **5*b*, for example the last disc of the same, to the shaft 4. In this case, however, so as not to subject the wire to a tensile load which is inadmissible on account of the high temperature of the wire, a slip clutch or a drive with a limited torque should then be interposed between the spur gear 8 and the shaft 4**.

In order to facilitate the initial charging of the apparatus with wire, the ends on both sides of the shafts 3 and 4, as shown in FIGS. 1 and 2, can be mounted in rotary plates 30, 31 which in turn are rotatably mounted in the side walls 1 by means of rollers 32 and can be held in position with respect to these side walls 1 in a manner described later. The two rotary plates can be coupled for common rotation, for example via chains 33, 34 and via chain wheels 36 and 37 connected together by a shaft 35. Expediently connected to or constructed in one piece with each rotary plate is a prismatic body 38, 39 in which the shaft end parts not enclosed by discs 5 rest so that these shaft end parts are screened as far as possible from the radiant heat of the furnace.

Moreover, a feed device 40 for feeding wire 19 is provided next to the apparatus. This device 40 is displaceable in a direction parallel to the longitudinal extent of the shafts 3, 4 and can be driven, for example via a chain and chain wheels (not shown) which interact with a screw spindle as a function of a rotation of the rotary plate system 30, 31 in accordance with the axial offset of the wire-guide grooves of the discs 5 arranged along the two axles or shafts and allocated to one another. To initially charge the apparatus according to the invention, the displaceable feed device 40 is arranged in such a way that the front end of the wire 19 is inserted at the operational wire-discharge point P2. Here, the wire is fixed on the last disc of the shaft 3 and subsequently, by rotating the rotary plate system 30, 31 until the first disc 5A on the shaft 3 is reached, is wound at the operational-side wire-entering point P1 around both disc rows 5*a* and 5*b* and laid in their guide grooves. For this purpose the shaft 3, for example, can be connected non-rotationally to the rotary plate 30 by a band brake (not shown) or another suitable means, while at the same time the arresting of the rotary plate system 30, 31 is neutralized.

If the shaft 9 is subsequently driven, the rotary plates 30 and 31 and all parts connected to them rotate about the geometric axis of the rotary plate system, with the wire being wound around the disc system, supported by the rotary plates, by means of the feed device 40 in the manner apparent from FIGS. 1 and 2.

As soon as the feed device 40 arrives opposite the operational entering point P1 of the wire and the rotary plates and shafts assume the position which can be recognized from FIGS. 1 and 2, the band brake mentioned is eased so that the shaft 3 can now rotate freely relative to the rotary plate 30, and at the same time the rotary plates 30, 31 are arrested again. If the shaft 9 is now driven, the shafts 3 and 4 rotate with the rotary plates stationary and operationally convey the wire through the apparatus from P1 to P2.

The entire system of disc-shape rotational bodies and shafts is enclosed in a hood 45 which is filled with inert gas to prevent oxidation of the wire when it is being heated. This hood 45, which, by means not shown as such, for example, screw spindles, ropes and rope pulleys or the like, can be lifted into the position designated in FIG. 2 by 45′ and shown in broken lines, has rectangular recesses 46 for accommodating the prismatic bodies 38, 39 and also passage openings 47, 48 for the entry and exit of the wire 19. The recesses 46, together with the prismatic bodies 38, 39, when the hood 45 is being lowered, effect the arresting of the rotary plates 30, 31 in the working position shown in FIGS. 1 and 2. If, on the other hand, the hood 45 is lifted into the position 45′, the rotary plates 30, 31, since the prismatic bodies 38, 39 are no longer held in place in the recesses 46, as already described earlier, can rotate freely about their axis.

Radiating heating bodies 49, 50 of any known embodiment are mounted on both side walls, which run parallel to the plane through the geometric axes of the two disc systems. Owing to the fact that relatively long wire sections run in a direction parallel to the radiating heating bodies, a favourable heat transfer from the heating bodies to the wire is ensured in this embodiment.

If heat-treatment apparatuses are used in interaction with drawing devices for successive diameter reductions and in each case subsequent heat treatment, occasional operating faults cannot be excluded. In advantageous embodiments of the apparatus according to the invention, design precautions are therefore provided which enable the effect of the heat radiation on the wire located in the apparatus to be interrupted as rapidly as possible without the wire, which is still hot and is therefore tending to oxidize rapidly, having to be removed from the inert gas atmosphere.

For this purpose, the lowerable radiation protection walls 51, 52 which can be recognized in FIGS. 1 and 2 are provided. By means of chains or wire ropes 53, 54 which are guided, for example, over chain pulleys 55, 56 and are loaded with a balancing weight 57, the radiation protection walls can be lowered into the rest position shown in FIGS. 1 and 2 or, in the event of an operating fault, can be rapidly lifted into he effective position 51′, 52′ shown in broken lines in FIG. 2.

Figure 3:
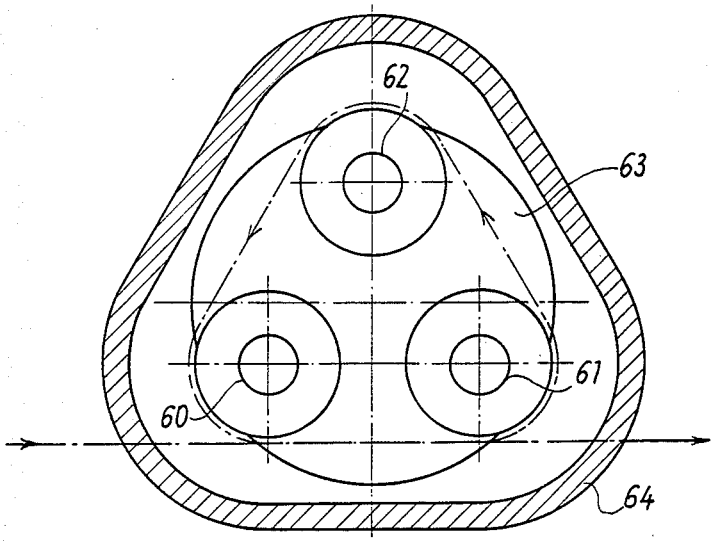
FIG. 3 shows a cross-section through a second exemplary embodiment.

FIG. 3 schematically shows an exemplary embodiment with three shafts or axles 60, 61, 62 supporting disc-shaped rotational bodies with again at least one shaft having to be motor-driven and at least one disc-shaped rotational body having to be connected non-rotationally to the driven shaft. The shafts or axles can again be mounted in a rotary plate 63. The advantage of this system is that, in accordance with the outer tangential planes, approximately forming an triangle, at in each case two adjacent disc rows of the system, three heating bodies can be arranged on the hood 64, as a result of which an even quicker and more intensive heating can be effected. On account of the special form of the hood 64, which is only indicated, the shafts or axles in this case are advantageously aligned vertically and, as shown for the exemplary embodiment according to FIG. 6, mounted overhung. A laying device possibly available, in accordance with the displaceable feed device 40 in FIG. 2, should then likewise be constructed to be displaceable in the vertical direction.

Figure 6:
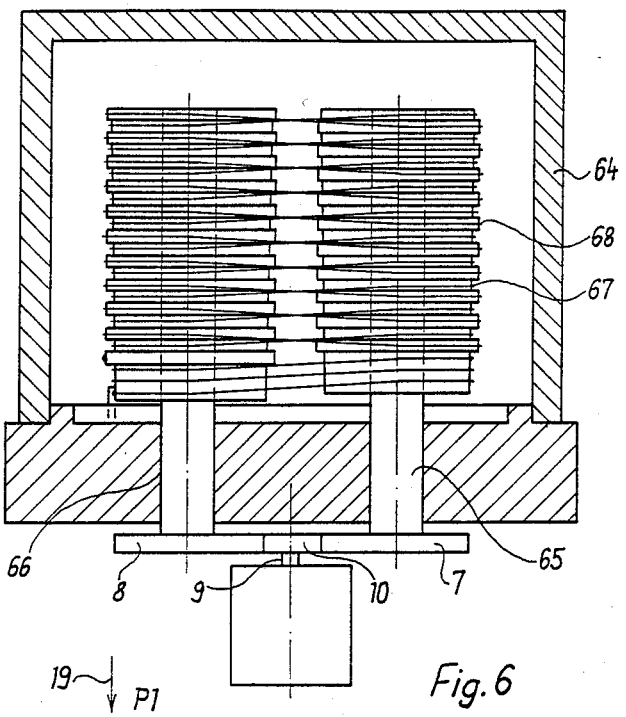
Figure 7:
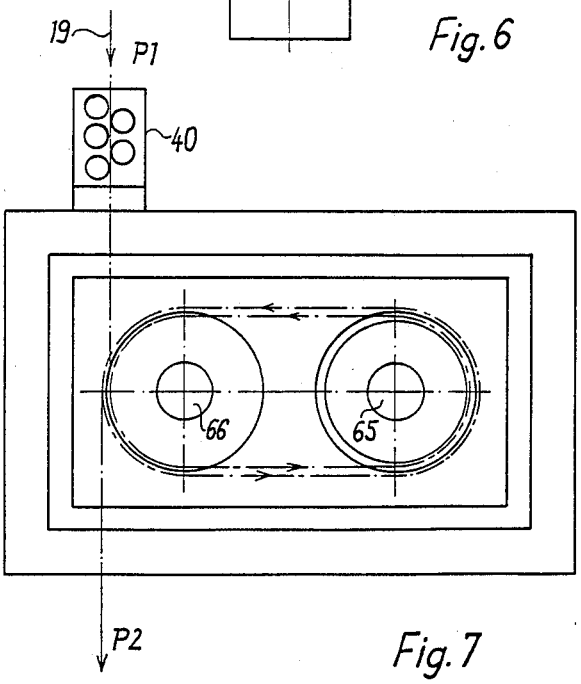

Finally, FIGS. 6 and 7 also show an exemplary embodiment in which two overhung-mounted vertical shafts 65, 66 are provided which can again be driven via spur gears 7, 8 and 10. In contrast to the embodiments discussed hitherto, different disc-shaped rotational bodies 67 and 68 are here alternately arranged along each shaft 65 and 66. The diameters of the discs 67, as in the exemplary embodiment according to FIG. 4, increase in steps from a minimum to a maximum value, whereas the discs 68 all have the same diameter, but this diameter is larger than the maximum diameter of a disc 67.

A wire, at first starting at the bottom and advancing upwards, can now be wound around the disc system in such a way that it always winds only around discs 67 of the adjacent disc rows in each case by an angle of 180°. As soon as the wire has reached the uppermost disc 67 of a disc row, it is taken to the uppermost disc 68 of the other disc row so as then to be guided back in the descending direction, but now only touching discs 68, into the plane in which it entered into the apparatus. At the same time, the wires winding around the discs 67 and the wires winding around the discs 68 cross one another free of contact in the space.

It becomes possible by this arrangement to direct a considerable wire length past close to the heated walls of the hood 64; moreover, the entry and exit openings for the wire in the hood are in alignment. The remaining design of all individual parts corresponds to the designs described hitherto.

We claim:

1. Apparatus for heat treating a single continuously moving metal wire in a heat-treatment area, comprising first and second shafts parallel to each other, first and second pluralities of discs mounted on said first and second shafts respectively, each disc of said first plurality of discs facing against a corresponding disc of said second plurality of discs, each of said discs having wire-guide grooves thereon, said grooves being arranged for winding a single wire in a helical manner about successive grooves of successive discs of said first and second pluralities while alternating between said grooves of said first and second pluralities, said first shaft being a drive shaft, said second shaft being driven in the same direction as said first shaft, said first plurality of discs including a first disc being driven by said first shaft, the remainder of said first and second pluralities of discs being freely rotatable on said first and second shafts, and means for supplying a single wire to said discs.

2. Apparatus according to claim 1, further comprising a disc mounted on said second shaft for rotation therewith.

3. Apparatus according to claim 1, wherein said discs of at least one of said first and second pluralities of discs have increasing diameters.

4. Apparatus according to claim 1 further comprising a disc mounted on said second shaft for rotation therewith, and a torque dependent slip clutch interconnecting said first and second shafts.

5. Apparatus according to claim 1, further comprising third and fourth pluralities of discs mounted on said first and second shafts respectively, said third plurality of discs being interdigitated with said first plurality of discs, and said fourth plurality of discs being interdigitated with said second plurality of discs, and means for winding a single wire around said first and second pluralities of discs in a first direction relative to said first and second shafts, and for winding said single wire around said third and fourth pluralities of discs in an opposite direction relative to said first and second shafts.

6. Apparatus according to claim 1, further comprising a third shaft parallel to said first and second shafts, and a third plurality of discs mounted on said third shaft, said first, second, and third shafts being disposed in a triangular arrangement, said apparatus further comprising a hood enclosing said first, second and third pluralities of discs, and heating bodies mounted on inner walls of said hood.

7. Apparatus according to claim 1, wherein each of said discs comprises a wheel having spokes, said wheel having a wheel rim which includes said wire-guide grooves, said spokes being formed as cooling vanes.

8. Apparatus according to claim 1, wherein said discs have hubs, said hubs being connected to bushes made from a refractory material, said bushes being mounted on said shafts.

9. Apparatus according to claim 1, further comprising guide discs made from a refractory material and arranged between said pluralities of discs.

10. Apparatus according to claim 1, further comprising a rotary plate wherein said first and second shafts are mounted, said rotary plate being mounted for rotation about an axis lying centrally between said first and second shafts, said apparatus further comprising means for transversely displacing a wire-feed device as a function of the rotation of said rotary plate.

11. Apparatus according to claim 1, further comprising a housing enclosing said first and second pluralities of discs, said housing having radiating heating surfaces arranged parallel to the common outer tangential planes of said first and second pluralities of discs.

12. Apparatus according to claim 11, further comprising a radiation screen wall located between said radiating heat surfaces and said common outer tangential planes of said first and second pluralities of discs.

13. Apparatus according to claim 10, wherein said housing comprises a fixed part and a hood part, said fixed part supporting a bearing arrangement for said rotary plate, said hood part being removably connected to said fixed part.

14. Apparatus according to claim 13, wherein said removable hood part includes arresting means for locking the rotation of said rotary plate when said housing is closed.

* * * * *